US006039184A

United States Patent [19]

Gale

[11] Patent Number: 6,039,184

[45] Date of Patent: Mar. 21, 2000

[54] FLEXIBLE PROTECTIVE ARTICLE AND PACKAGING USING SAME

[76] Inventor: Gregory W. Gale, 3380 Atlas Peak Rd., Napa, Calif. 94558

[21] Appl. No.: 09/208,627

[22] Filed: Dec. 8, 1998

Related U.S. Application Data

[63] Continuation-in-part of application No. 08/859,384, May 20, 1997, abandoned.

[51] Int. Cl.[7] ..... B65D 81/127

[52] U.S. Cl. ..... 206/586; 206/594; 428/182; 428/184

[58] Field of Search ..... 206/586, 591, 206/594, 821; 229/939; 428/179–186

[56] References Cited

U.S. PATENT DOCUMENTS

| | | | |
|---|---|---|---|
| 215,648 | 5/1879 | Meech | 428/181 |
| 1,964,178 | 6/1934 | Rosener | 428/181 |
| 2,555,564 | 6/1951 | Berman | 428/181 |
| 2,677,993 | 5/1954 | Ens | 229/939 |
| 2,905,315 | 9/1959 | Doll | 206/594 |
| 3,762,626 | 10/1973 | Dorsey | 206/586 |
| 4,164,588 | 8/1979 | Johnson | 206/594 |

*Primary Examiner*—Jim Foster

*Attorney, Agent, or Firm*—Flehr Hohbach Test Albritton & Herbert

[57] ABSTRACT

A flexible protective article for engaging a surface of a product for protecting the product from shock during shipment comprising a member formed of a sheet of material of molded pulp having a substantially uniform thickness throughout. The member has a plurality of generally parallel spaced apart flutes formed therein of a substantially uniform thickness extending at an angle between 15° and 75° with respect to a first imaginary plane extending through the flutes and extending inwardly and outwardly with respect to the first imaginary plane. Each of the flutes in a normal unloaded position has first and second legs angled with respect to each other and terminating in an apex. The first leg has a first length and the second leg has a second length. The second length is less in length than the first length. The first and second legs extend at angles on the same side of a second imaginary plane extending perpendicular to the first imaginary plane and extending through the apex. The apex is rounded to provide rounded apices on the plurality of flutes. The flutes are capable of bending from the normal unloaded position through the second imaginary plane and serving as shock absorbing dampers to absorb shock forces applied to the product when the foldable protective article is disposed between the product and the shipping container by being capable of bending during absorption of shock forces and springing back after the shock forces have passed.

19 Claims, 6 Drawing Sheets

FLEXIBLE PROTECTIVE ARTICLE AND PACKAGING USING SAME

This is a continuation-in-part of application Ser. No. 08/859,384 filed May 20, 1997, now abandoned.

This invention relates to a foldable protective article and packaging using the same and more particularly to load bearing protective corners and flexible end caps.

In the past, protection has been provided for heavy articles packed in corrugated shipping boxes. Typically this has been in the form of styrofoam in various configurations such as globules formed in various shapes that are used as a packing material around the product separating the product from the wall of the shipping box or carton. Also, solid pieces of styrofoam have been utilized for corner protectors and the like. The use of such plastic material such as styrofoam for such purposes has been found to be environmentally objectionable for a number of reasons including difficulty of disposal. There is therefore a need for a new and improved protective article which can overcome these objections.

In general, it is an object of the present invention to provide a foldable protective article and packaging using the same which is environmentally acceptable.

Another object of the invention is to provide an article and packaging using the same which can be utilized for load bearing protective corners as well as for flexible end caps and other articles.

Another object of the invention is to provide an article of the above character which can be made from molded fibers.

Another object of the invention is to provide an article of the above character which is biodegradable.

Another object of the invention is to provide an article of the above character which can be folded into desired geometrical configurations to accommodate the product being shipped and also to accommodate the packaging utilized for the product.

Another object of the invention is to provide an article and packaging of the above character which is capable of being folded.

Another object of the invention is to provide an article and packaging of the above character which can be readily used.

Another object of the invention is to provide an article and packaging using the same of the above character which can be utilized with substantially conventional automatic folding machinery utilized in packaging.

Another object of the invention is to provide an article of the above character which can be readily and economically manufactured.

Additional objects and features of the invention will appear from the following description in which the preferred embodiments are set forth in conjunction with the accompanying drawings.

In general, the flexible protective article of the present invention is for engaging a surface of a product for protecting the product from shock during shipment and is comprised of a member formed of a sheet of molded fiber which has a desired configuration. The member has a plurality of generally parallel spaced apart flutes extending at an angle of between 15° and 75° from the plane of the sheet and extending inwardly and outwardly with respect to the plane of the sheet and having in cross section rounded extremities. The flutes serve as dampers to absorb shock forces applied to the product during shipment of the product and thus protect the product.

More in particular, the flexible protective article 11 consists of a unitary member 12 formed of molded fibers as for example molded pulp which typically is made out of a mixture of newspaper to which has been added water with a touch of alum to balance the pH in the water. Other fibrous material such as leather, plants and the like can be used. If a brown or off white color is desired for the member, this can be accomplished by adding recycled corrugated board from containers. Desired coloring also can be obtained by use of dyes added to the pulp before molding.

Figure 1:
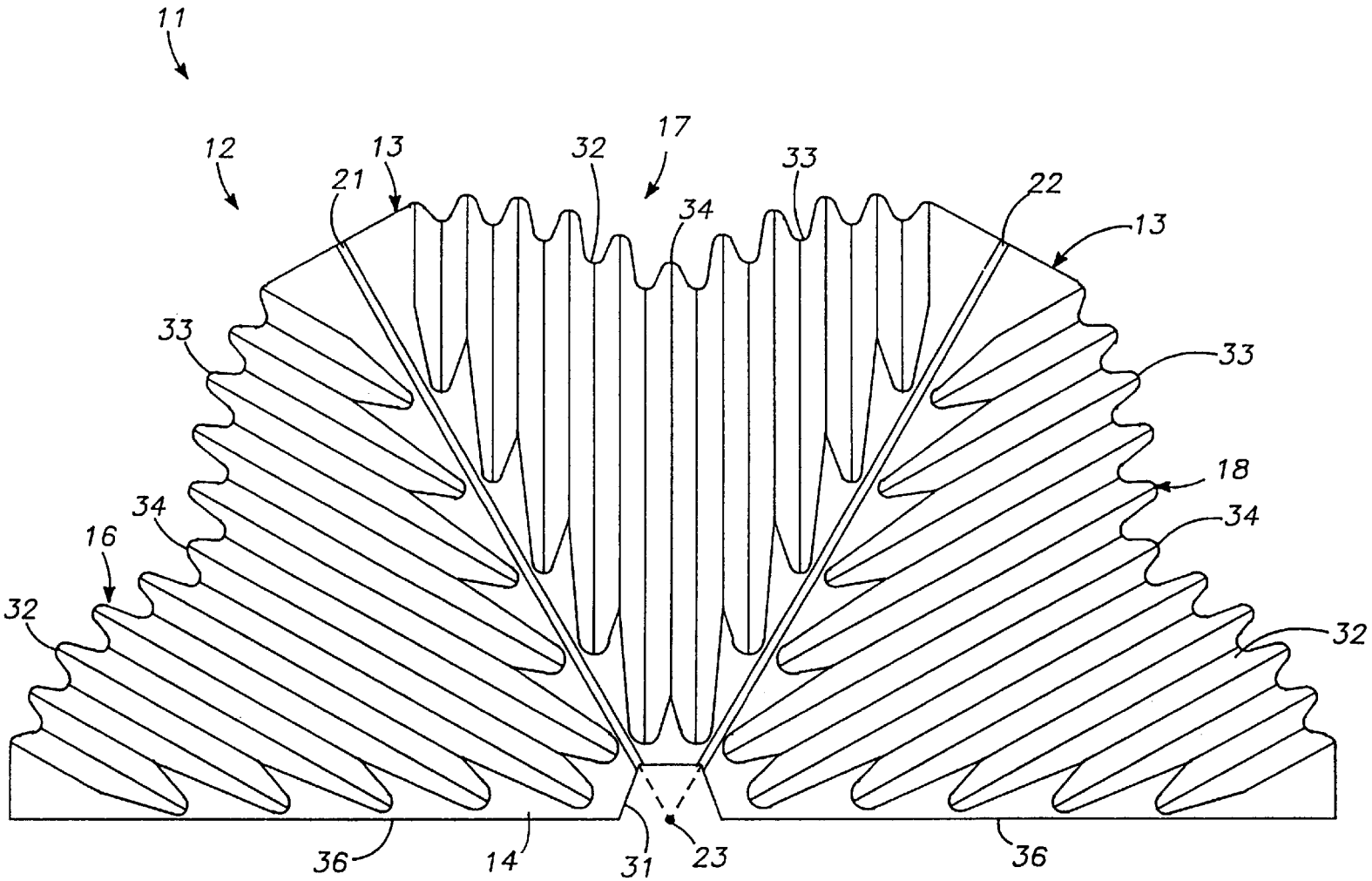
FIG. 1 is a plan view of a foldable protective article incorporating the present invention and more particularly a load bearing protective corner which has been molded and lies in the plane.

As shown in FIG. 1, the member 12 is in the form of a sheet 13 having a thickness ranging from 0.060" to 0.350" and which lies in a plane 14. The sheet 13 is provided with three segments 16, 17 and 18 with segments 16 and 17 being adjoined along a fold line 21 and segments 17 and 18 adjoining each other along a fold line 22. The fold lines 21 and 22 extend at 60° along lines which intersect at an imaginary center point 23 as shown in FIG. 1.

Each of the segments 16, 17 and 18 is provided with a plurality of spaced apart parallel molded V-shaped or U-shaped flutes 26. The flutes or ribs 26 do not have undercuts in them so that the member 12 can be readily withdrawn from molds after it has been molded.

The molded V-shaped or U-shaped flutes 26 provide peaks and valleys 27 and 28 respectively on opposite sides with the peak on one side being the valley on the other side. As can be seen from FIGS. 2 and 4, the flutes 26 extend in opposite directions from the plane 14 of the sheet. As hereinafter explained, this angling of the flutes is desirable to increase the shock absorbing capabilities of the articles as hereinafter described. The central valley 28 of the flutes in each section looking from the top side extends along a line which extends through the imaginary center point 23. The successive adjacent valleys 28 on opposite sides of the central valley 28 have progressively decreasing shorter lengths up to the end of the segment. The inner and outer extremities of the molded flutes 26 in cross section are rounded as shown in FIG. 4 and as hereinafter more in particular described to provide improved cushioning.

Figure 2:
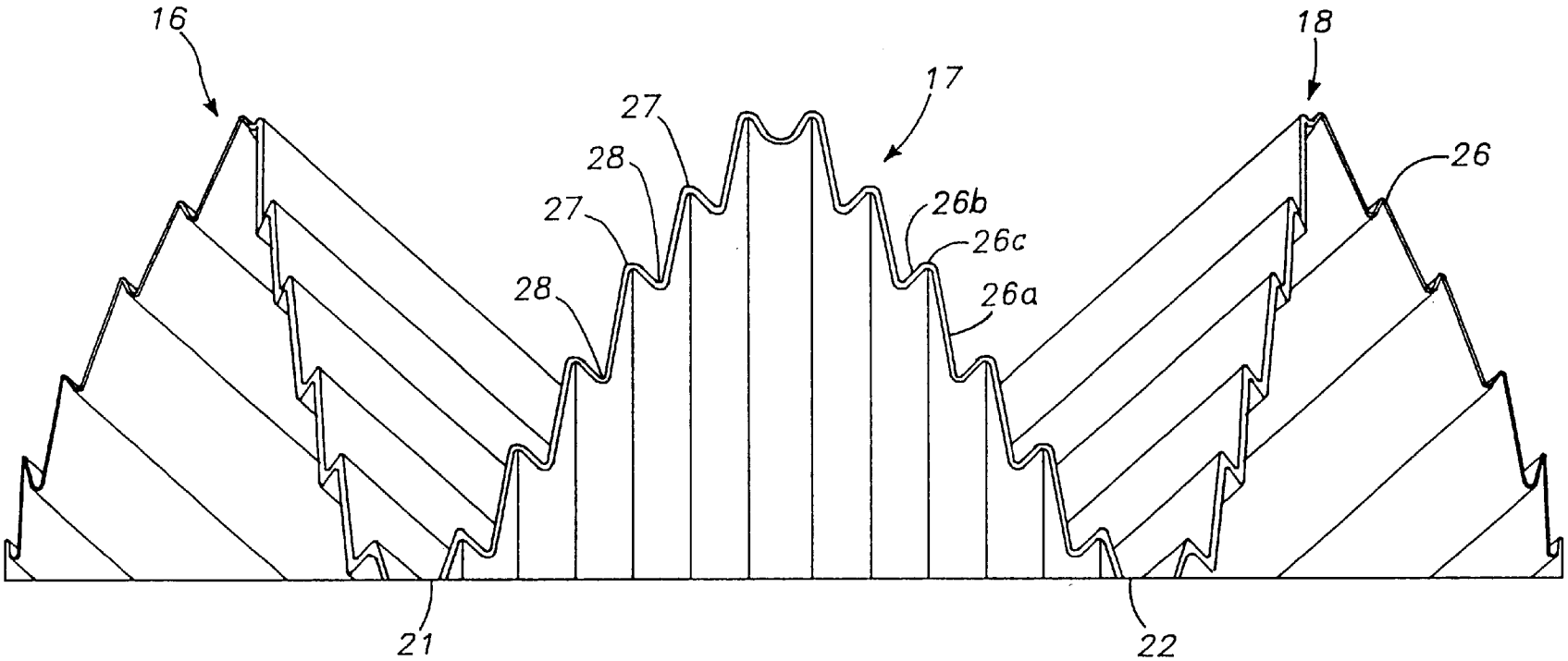
FIG. 2 is a side elevational view of the article shown in FIG. 1 folded to form three triangular segments.
Figure 3:
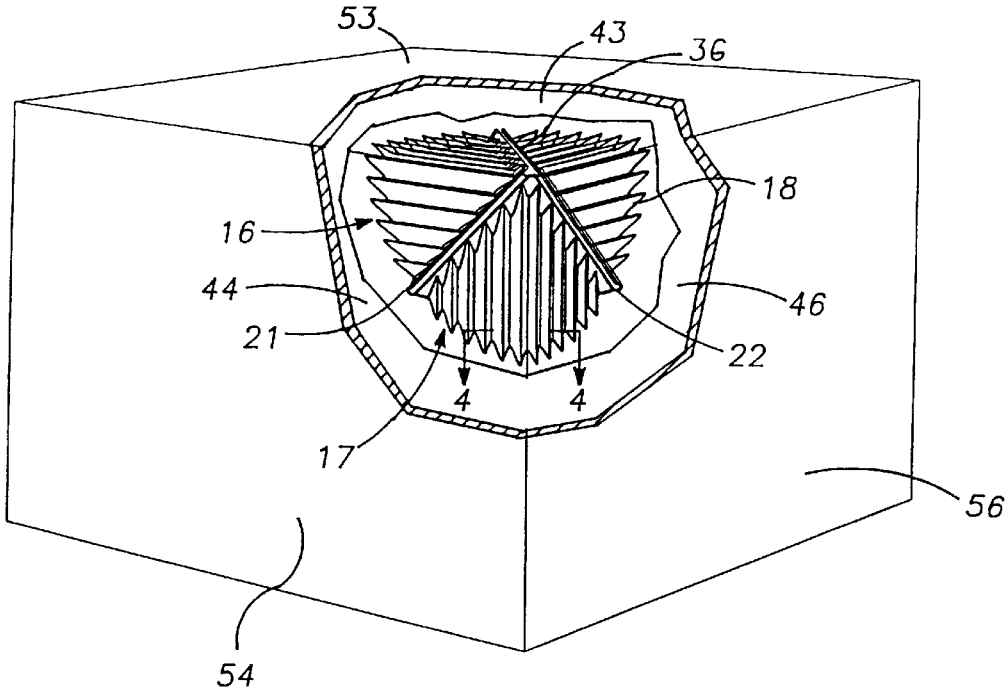
FIG. 3 is an isometric view showing the article in FIG. 2 with additional folds and to form a load bearing protective corner such as shown in FIG. 3 disposed between a product and a corrugated shipping container.
Figure 4:
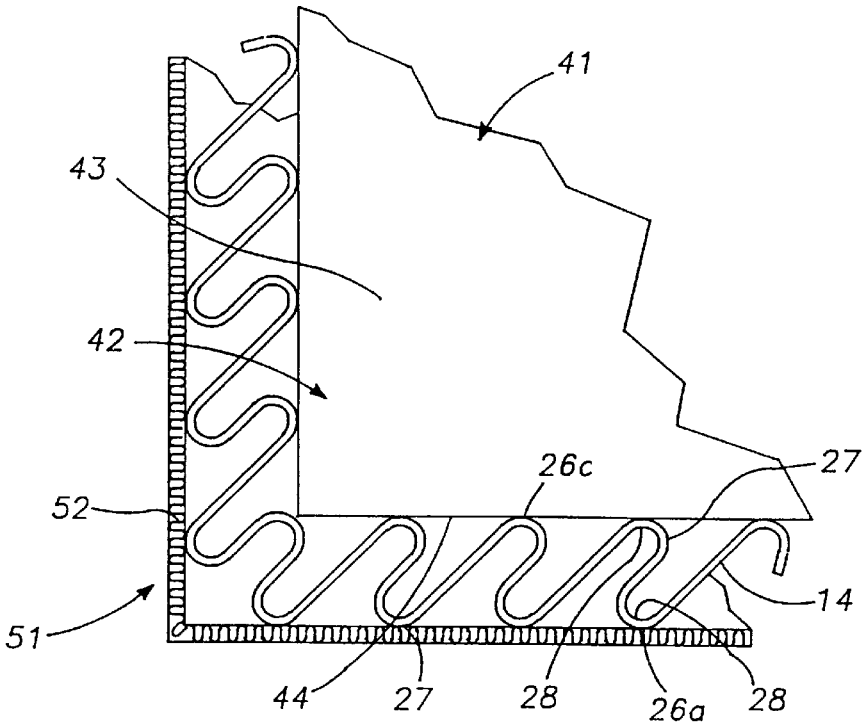
FIG. 4 is a cross sectional view taken along the line 4—4 of FIG. 3.
Figure 5:
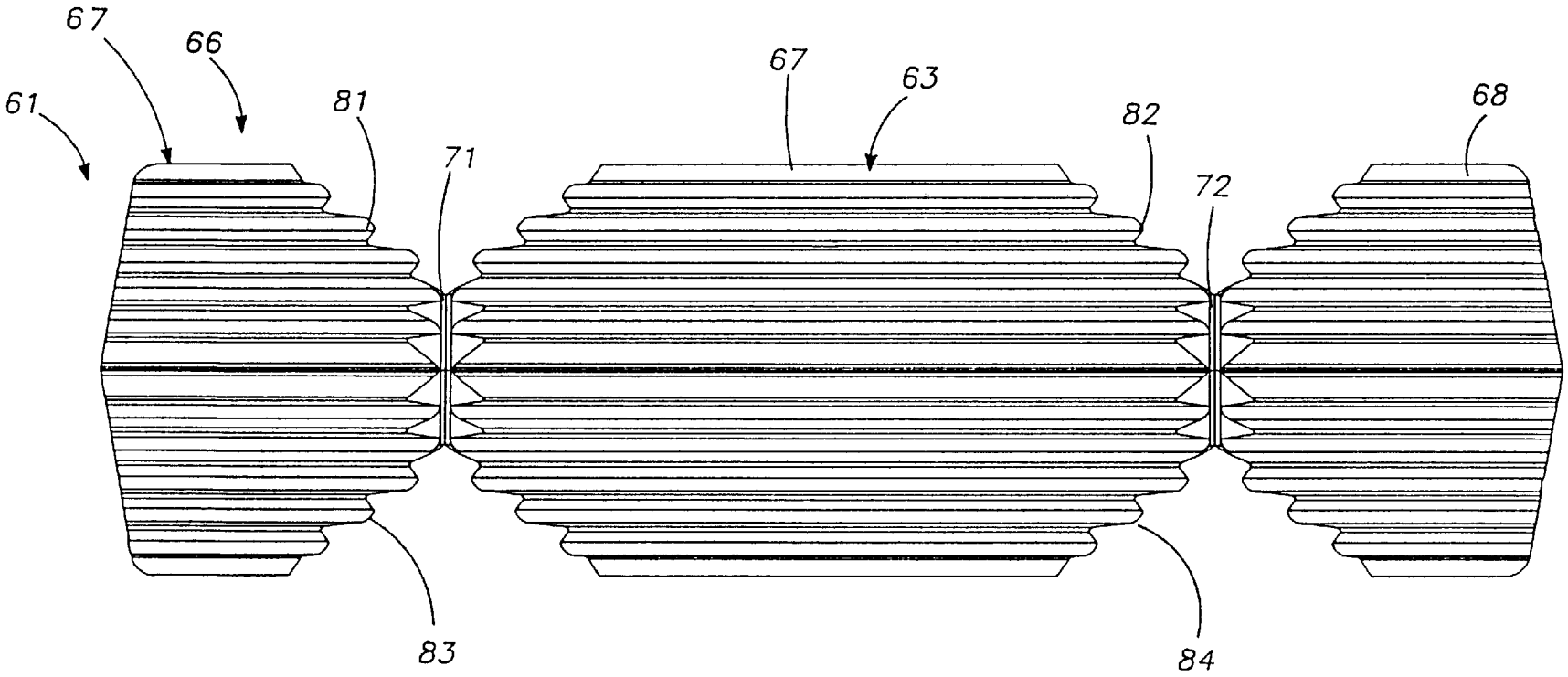
FIG. 5 is a plan view of another embodiment of a foldable protective article incorporating the present invention and more particularly a flexible end cap in sheet form lying in a plane.
Figure 6:
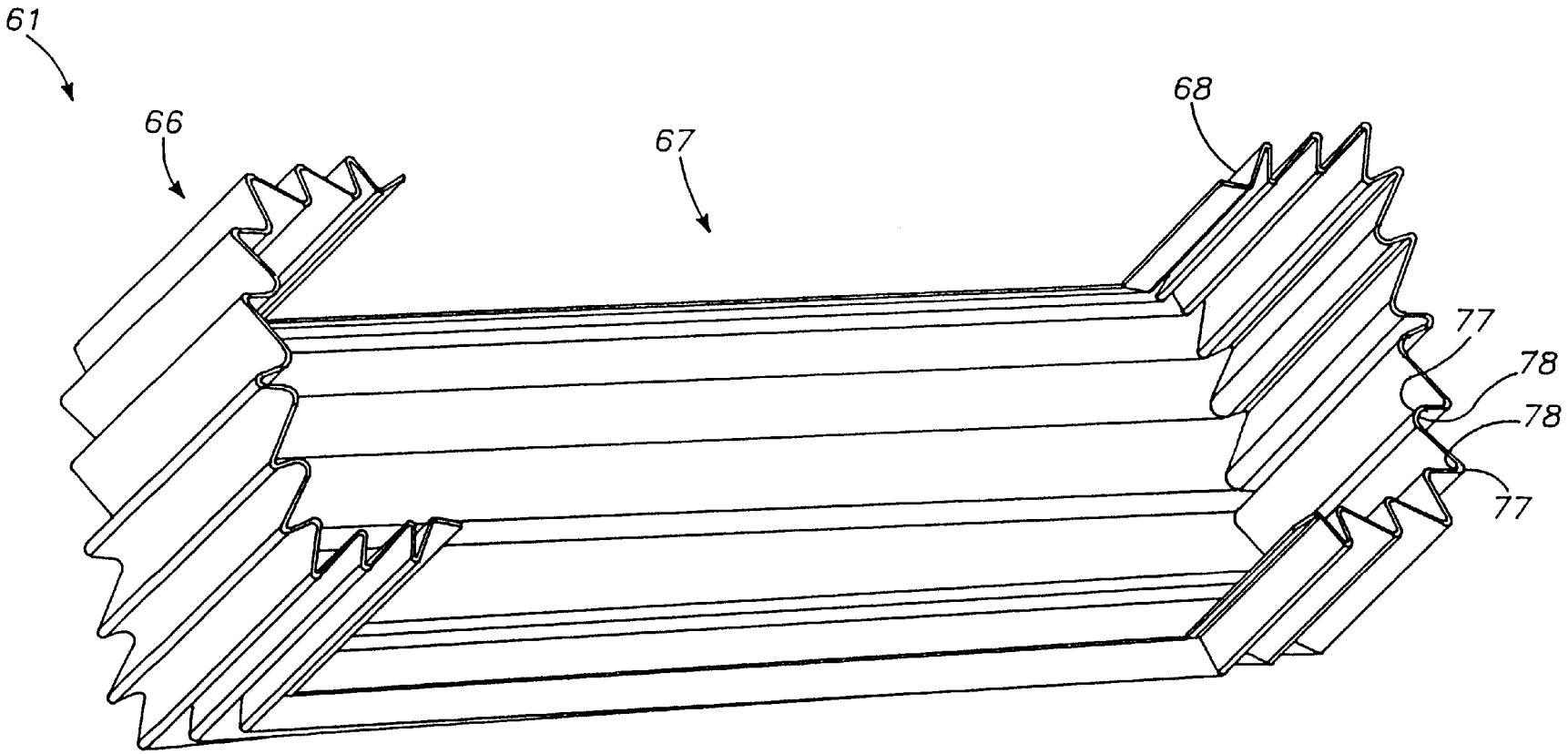
FIG. 6 is an isometric view showing the article in FIG. 5 folded into a flexible end cap.

The flutes can be more particularly described and as shown in FIGS. 2 and 4 as extending at an angle between 15° and 75° from a first imaginary plane extending through the flutes and extending inwardly and outwardly with respect to the first imaginary plane. Each of the flutes in a normal position has first and second legs 26*a* and 26*b* angled with respect to each other so that they terminate at an apex 26*c*.

The first leg has a first length and the second leg has a second length. The second length is less in length than the first length typically by a ratio of 0.2 to 0.9. The first and second legs 26*a* and 26*b* extend at angles on the same side of a second imaginary plane extending perpendicular to the first imaginary plane and extending through the apex 26*a*. The apex is rounded in cross section to provide rounded apices on the plurality of flutes 26. The flutes 26 when molded in such a configuration are capable of bending from a normal unloaded condition in which no forces are being applied to the flutes and are movable therefrom through the second imaginary plane as forces are applied to the flutes so that the flutes serve as shock absorbing dampers to absorb shock forces applied to the flutes. In this way, the flutes 26 are capable of absorbing shock forces applied to a product in contact with the flutes.

As shown in FIG. 2, each of the segments 16, 17 and 18 is capable of being folded along the adjacent fold line 21 or 22 so that each segment forms two sides of a triangle having sides extending at approximately 60°. The sheet 13 is provided with a centrally disposed cut out 31 which is centered about the imaginary center point 23 as shown in FIG. 1. Each segment of the sheet is also provided with first and second outwardly curved surfaces 32 and 33 which are curved generally inwardly toward the imaginary center point 23 and have generally equal radiuses with a length which correspond approximately to one-half of the length of the fold lines 21 and 22 and adjoin at a small curve 34 which is centered on the central valley 28. The other edges 36 of the segments 16 and 17 opposite the fold lines 21 and 22 extend along a line which extends through the imaginary center point 23. The first and second fold lines 21 and 22 extend at a 60° angle with respect to each other to the imaginary center point 23.

Each section is comprised of a plurality of shock absorbing molded flutes 26 which are spaced apart and parallel to each other and having a uniform slope extending toward the imaginary center point 23, the flutes 26 in each section having a direction facing an imaginary center point and in cross section being arranged to progressively increase in height to the fold line on one side of the fold line and to progressively decrease in height on the other side of the fold line. The sloping surface on one side of the fold line lies in a plane which forms an angle which is complementary to the plane of the sloping surface on the opposite side of the fold line of the adjacent section.

In FIG. 4 it is shown how the member 12 is further folded to serve as a load bearing protective corner in use for packaging a product as for example a stereo unit 41 having a rectangular shape having a corner formed by top surface 43 and side surfaces 44 and 46 all extending at 90° with respect to each other and enclosed in a shipping carton 51 of a conventional type as for example a carton formed of corrugated board 52. The carton 51 is provided with a top side 53 adjoining side walls 54 and 56 extending at right angles to the top 53 and extending at right angles with respect to each other. Thus as shown, the segment 17 is folded over the edge formed by the adjoining sides 44 and 46 of the product. The segment 16 is overlying the adjoining sides 44 and 43 and segment 18 is overlying the adjoining sides 43 and 46 so that one-half portion of the segment 16 and one-half portion of the segment 18 overlies the top side 43 and one portion of the segment 16 and one portion of the segment 17 overlies the side 44 and one portion of segment 18 and one portion of segment 17 overlies the wall 46. Similarly, the sides 53, 54 and 56 of the carton 51 extend over the interior portions of the same segments so that the foldable protective article 11 serves as a load bearing protective corner for supporting a stereo unit 41 within the shipping carton 51. Several additional foldable protective articles 11 in the form of load bearing protective corners can be provided on the other seven corners of the product in the form of a stereo unit 41 to support the product within the carton so that its side walls are spaced from the side walls of the carton to provide load bearing and shock absorbing capabilities to protect the product from any shock which may occur during shipment.

The flutes 26 as designed in the foldable protective article 11 serve as torsion elements because one end of the flute is open whereas the other end is secured and forms a part of the member 12 so that it is capable of absorbing shock and still returning to its original configuration after the shock force has passed. This torsion element effect is enhanced by the fact that the flutes are canted or inclined at an angle further facilitating this capability of absorbing shock forces and springing back to its original configuration so that it is ready to absorb future shock forces when and if they occur. Because the flutes have a capability of bending rather than collapsing because of the rounded apices of the flutes, they can readily absorb shock forces and still spring back and return to their original configuration after the shock force has passed so that they are ready to absorb additional shock forces when and if they occur. As can be appreciated, the shock forces which can be absorbed without destructive deformation of the flutes can be selected by an appropriate choice of height or width of the flutes as well as the length of the flutes and the angle at which the flutes extend. Additional desired characteristics can be achieved by selecting an appropriate material thickness. Also the length of the flutes can be selected to obtain the desired capabilities for absorbing shock forces.

Although the flexible protective article shown in FIGS. 1 through 4 has been shown as being used for protecting right angle corners, it should be appreciated that the flexible protective article can be molded to have shapes which can accommodate curved surfaces as for example curved or rounded corners and the like.

The material which is utilized for the foldable protective article as hereinbefore explained utilizes material which is sensitive to the environment. The article can be manufactured from recycled materials as for example newspaper and the like hereinbefore described. In addition, the article after it has been used can again be recycled and formed into a molded pulp and thereafter used for providing additional foldable protective articles incorporating the present invention.

Another embodiment of a foldable protective article incorporating the present invention is shown in FIGS. 5 through 8. The foldable protective article 61 as shown therein consists of a member 62 which can be formed from molded fibers and other materials as hereinbefore described for the foldable protective article 11 and is formed from a sheet 63 lying in an imaginary plane 64. The sheet 63 is formed into a plurality of segments 66, 67 and 68 with segments 66 and 67 adjoining each other along a fold line 71 and segments 67 and 68 adjoining each other along fold line 72. Each of the segments 66, 67 and 68 are provided with a plurality of spaced apart parallel flutes 76 which form peaks and valleys 77 and 78 on opposite sides or top and bottom sides. The flutes 76 are of various lengths having the greatest length at the center of the segment and gradually decreasing in length so that they open into V-shaped recesses 81 and 83 between segments 66 and 67 and recesses 82 and 84 between segments 67 and 68.

As shown in FIG. 4, the member 62 is capable of being folded in a number of different ways. For example as shown in FIG. 4, the segment 66 can be folded at right angles with respect to the segment 67 and similarly, the segment 67 can be folded at right angles to the segment 68 to provide three sides for a foldable protective article. In addition, each half of each segment extending beyond the fold lines 71 and 72 can be folded to form a flexible end cap. For example, article 62 can be folded about a rectangular product as for example a stereo unit of the type hereinbefore described with the end cap serving as a flexible protective article 61 covering one end of the stereo unit and extending over two corners of the stereo unit and having portions of the segments underlying the top and bottom surfaces of the stereo unit. In this manner, two of the foldable protective articles 61 can be utilized for providing two end caps for enclosing the case of a stereo unit and for placing the same within a shipping carton of the type hereinbefore described.

Figure 7:
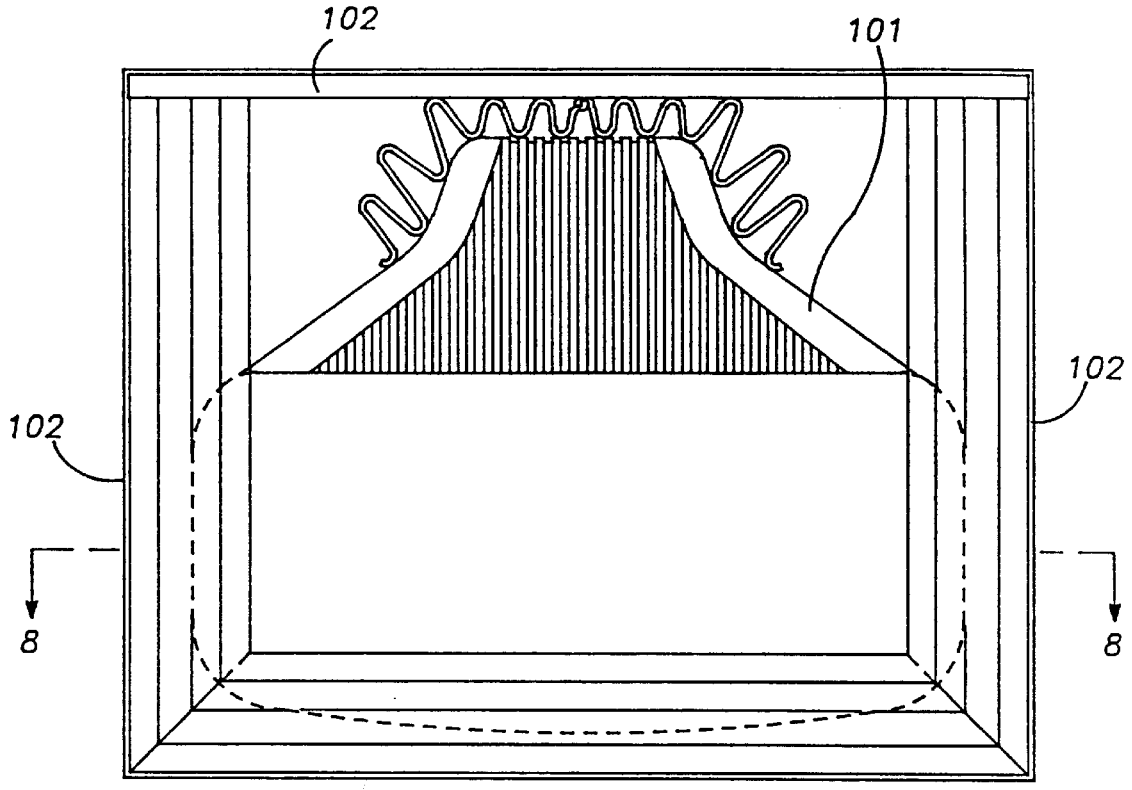
FIG. 7 is a top plan view of the product in the form of a television tube packaged in a shipping container and utilizing the flexible end caps shown in FIG. 6.
Figure 8:
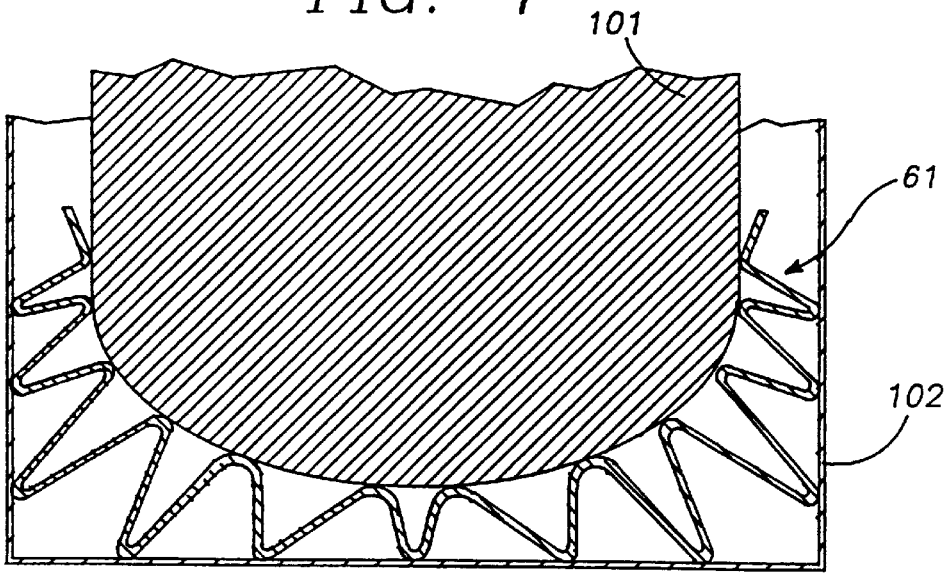
FIG. 8 is a cross sectional view taken along the line 8—8 of FIG. 7.

The foldable protective article 61 can also be utilized for packaging of products having curved surfaces as for example a television monitor 101 as shown in FIG. 7. The television monitor 101 is packaged within a shipping container 102 of a conventional type as for example of corrugated board.

It can be seen from the foregoing that there has been provided a foldable protective article which can be made from molded fiber obtained from recycled materials and which can again be recycled, making it possible to replace materials such as polystyrene conventionally used for packaging products to be shipped. The foldable protective article can readily accommodate various types and sizes and shapes of products. It can be produced economically without the environmental drawbacks of other packaging materials. The flexible protective articles utilize a V-shaped fold. The article includes inclined flutes which serve as shock absorbing dampers that engage the product and serve to support the product within the shipping container. The foldable protective articles can be shipped to the user in a flat form and thereafter folded into the desired configuration to form the protective article. The flexible protective articles make it possible to provide good support for the product within the container with a snug fit. The flutes provided therein serve as dampers which will absorb impact and return to their original memorized memory to still provide a snug fit for the product in the container after absorbing shock. Thus the flexible protective article has a built in memory which is atypical for paper products as for example from which the foldable protective article is made. Since it can be supplied and kept in flat form, warehouse storage area required is greatly reduced until it is ready to be used. In addition it is a product which is sensitive to the environment and which can be economically produced.

What is claimed:

1. A flexible protective article for engaging a surface of a product for protecting the product from shock during shipment comprising a member formed of a molded sheet of material of molded pulp having a substantially uniform thickness throughout, said member having a plurality of generally parallel spaced apart flutes formed therein by the molding of said molded pulp and of a substantially uniform thickness extending at an angle between 15° and 75° with respect to a first imaginary plane extending through the flutes and extending inwardly and outwardly with respect to the first imaginary plane to provide flutes on opposite sides of the molded sheet, each of said flutes in a normal unloaded condition having first and second legs angled with respect to each other and terminating in an apex, said first leg having a first length and said second leg having a second length, said second length being less in length than the first length, said first and second legs extending at angles on the same side of a second imaginary plane extending perpendicular to the first imaginary plane and extending through the apex, said apex being rounded to provide rounded apices on the plurality of flutes, said flutes on opposite sides being free and being capable of bending from the normal unloaded position through the second imaginary plane and serving as shock absorbing dampers to absorb shock forces applied to the product when the foldable protective article is disposed between the product and the shipping container by being capable of bending during absorption of shock forces and springing back after the shock forces have passed.

2. An article as in claim 1 wherein the length of the second leg has a ratio of 0.2 to 0.9 with respect to the length of the first leg.

3. An article as in claim 1 which can be shipped in one piece stacked with the flutes in a nested configuration one above the other in a plurality greater than two ready for use.

4. An article as in claim 1 wherein said member is formed of at least first and second sections adjoining each other and having a molded fold extending therebetween.

5. An article as in claim 1 having first, second and third segments with the first and second segments adjoining each other along a first molded fold and the second and third segments adjoining each other along a second molded fold.

6. An article as in claim 5 wherein said first and second molded folds extend at an angle with respect to each other.

7. An article as in claim 5 wherein said first and second molded folds are parallel to each other.

8. An article as in claim 5 wherein each of said segments is capable of being formed into a V-shaped configuration.

9. An article as in claim 1 wherein the material of said sheet has a thickness ranging from 0.060" to 0.350".

10. An article as in claim 1 wherein said article can be folded along at least one of the flutes to provide a V-shaped configuration to provide protection for at least two surfaces of the product.

11. A flexible protective article for engaging a surface of a product for protecting the product from shock during shipment comprising a member formed of a sheet of material of molded pulp having a substantially uniform thickness throughout, said member having a plurality of generally parallel spaced apart flutes formed therein of a substantially uniform thickness extending at an angle between 15° and 75° with respect to a first imaginary plane extending through the flutes and extending inwardly and outwardly with respect to the first imaginary plane, each of said flutes in a normal unloaded condition having first and second legs angled with respect to each other and terminating in an apex, said first leg having a first length and said second leg having a second length, said second length being less in length than the first length, said first and second legs extending at angles on the same side of a second imaginary plane extending perpendicular to the first imaginary plane and extending through the apex, said apex being rounded to provide rounded apices on the plurality of flutes, said flutes being capable of bending from the normal unloaded position through the second imaginary plane and serving as shock absorbing dampers to absorb shock forces applied to the product when the foldable protective article is disposed between the product and the shipping container by being capable of bending during absorption of shock forces and springing back after the shock forces have passed, said member being formed of at least first and second sections adjoining each other and having a fold line extending therebetween, said flutes extending at angles out of parallel with respect to the fold lines.

12. A flexible protective article for engaging a surface of a product for protecting the product from shock during shipment comprising a member formed of a sheet of material of molded pulp having a substantially uniform thickness throughout, said member having a plurality of generally parallel spaced apart flutes formed therein of a substantially uniform thickness extending at an angle between 15° and 75° with respect to a first imaginary plane extending through the flutes and extending inwardly and outwardly with respect to the first imaginary plane, each of said flutes in a normal unloaded condition having first and second legs angled with respect to each other and terminating in an apex, said first leg having a first length and said second leg having a second length, said second length being less in length than the first length, said first and second legs extending at angles on the same side of a second imaginary plane extending perpendicular to the first imaginary plane and extending through the apex, said apex being rounded to provide rounded apices on the plurality of flutes, said flutes being capable of bending from the normal unloaded position through the second imaginary plane and serving as shock absorbing dampers to absorb shock forces applied to the product when the foldable protective article is disposed between the product and the shipping container by being capable of bending during absorption of shock forces and springing back after the shock forces have passed, said member having first, second and third segments with the first and second segments adjoining each other along a first fold line and the second and third segments adjoining each other along a second fold line, said member being formed with a cut out in alignment with the first fold line between the first and second segments and a cut out in registration with the second fold line between the second and third segments.

13. An article as in claim 12 wherein said member is formed with an additional cut out in registration with the first fold line opposite the first cut out adjacent the first fold line and a second cut out in registration with the second fold line opposite the first cut out in registration with the second fold line.

14. A load bearing protective corner for use in a six sided container having corners formed by three adjoining walls extending at 90° with respect to each other and for supporting a six sided product therein and being movable from a flat unfolded configuration to a folded configuration comprising a member formed of a sheet of molded fiber, said member being unitary and having first, second and third segments, the first and second segments adjoining each other along a first fold line and the second and third segments adjoining each other along a third fold line, said first and second fold lines extending at a 60° angle with respect to each other to an imaginary center point, each of said sections comprising a plurality of shock absorbing flutes which are spaced apart and parallel to each other and having a uniform slope extending in a direction toward the imaginary center point, the flutes in each section direction facing an imaginary center point and in cross section being arranged to progressively increase in height to the fold line on one side of the fold line and to progressively decrease in height on the other side of the fold line, the sloping surface on one side of the center line lying in a plane which forms an angle which is complementary to the plane of the sloping surface on the opposite side of the center line of the adjacent section.

15. Packaging for packaging a product comprising a shipping carton having spaced apart parallel top and bottom walls, spaced apart parallel side walls and spaced apart and parallel end walls adjoining the side walls and the top and bottom walls, a product disposed within the shipping carton, a protective article for engaging the product and for suitably retaining the product within a predetermined position within the container, said protective article comprising a member formed of a sheet of molded pulp of substantially uniform thickness, said member having a plurality of generally parallel spaced apart flutes formed therein of substantially uniform thickness extending at an angle between 15° and 75° with respect to a first imaginary plane extending through the member and extending inwardly and outwardly with respect to the imaginary plane, each of said flutes in a normal unloaded position having first and second legs angled with respect to each other and terminating in an apex, said first leg having a first length and said second leg having a second length, said second length being less in length than the first length, said first and second legs extending at angles on the same side of a second imaginary plane extending perpendicular to the first imaginary plane and extending through the apex, said apex being rounded to provide rounded apices on the plurality of flutes, said rounded apices engaging the surface of the product and engaging the surface of the container whereby the flutes serve as dampers to absorb shock forces applied to the packaging to protect the product during shipment by being capable of bending during absorption of shock forces and springing back after the shock forces have passed.

16. Packaging as in claim 15 wherein said article has a V-shaped fold there in so that said article can engage at least two surfaces of the product.

17. Packaging as in claim 15 wherein said article is comprised of first, second and third segments with the first and second segments adjoining each other along a first fold line and the second and third segments adjoining each other along a second fold line and wherein said first, second and third segments are folded into a V-shape so that each segment engages at least two surfaces of the product.

18. Packaging as in claim 17 wherein said first and second fold lines extend at an angle with respect to each other.

19. An article a s in claim 17 wherein said first and second fold lines a re parallel to each other.

* * * * *